US007648424B2

(12) United States Patent
Hinojosa

(10) Patent No.: US 7,648,424 B2
(45) Date of Patent: Jan. 19, 2010

(54) GOLF CLUB HEAD HAVING CONCAVELY CURVED FACE

(76) Inventor: Albert L. Hinojosa, 1834 Crystal Ct., Houston, TX (US) 77008

( * ) Notice: Subject to any disclaimer, the term of this patent is extended or adjusted under 35 U.S.C. 154(b) by 13 days.

(21) Appl. No.: 11/986,692

(22) Filed: Nov. 26, 2007

(65) Prior Publication Data

US 2008/0132349 A1 Jun. 5, 2008

Related U.S. Application Data

(60) Provisional application No. 60/872,141, filed on Dec. 1, 2006.

(51) Int. Cl.
*A63B 69/36* (2006.01)
*A63B 53/04* (2006.01)

(52) U.S. Cl. ..... 473/236; 473/242; 473/325; 473/330

(58) Field of Classification Search ..... 473/219, 473/231, 236, 324, 330–331, 242, 325
See application file for complete search history.

(56) References Cited

U.S. PATENT DOCUMENTS

| | | | | | |
|---|---|---|---|---|---|
| 807,736 | A | * | 12/1905 | Foulis | 473/330 |
| 1,211,708 | A | * | 1/1917 | Hudson | 473/330 |
| 1,467,714 | A | * | 9/1923 | Doerr | 473/330 |
| 1,525,137 | A | * | 2/1925 | Lawton | 473/330 |
| 2,472,978 | A | | 6/1949 | Mahon | |
| 2,826,417 | A | | 3/1958 | Marcoccio | |
| 3,881,733 | A | * | 5/1975 | Csernits | 473/330 |
| 4,139,198 | A | * | 2/1979 | Kanavas | 473/236 |
| 4,165,076 | A | | 8/1979 | Cella | |
| 5,718,644 | A | * | 2/1998 | Donofrio | 473/340 |
| 5,997,411 | A | * | 12/1999 | Holub | 473/282 |
| D425,952 | S | * | 5/2000 | Boyer | D21/752 |
| 6,162,131 | A | * | 12/2000 | Falzone | 473/330 |
| 6,217,460 | B1 | | 4/2001 | Broadbridge et al. | |
| 6,267,690 | B1 | * | 7/2001 | Salmon | 473/325 |
| 6,270,423 | B1 | * | 8/2001 | Webb | 473/226 |
| 6,273,827 | B1 | * | 8/2001 | Hockerson et al. | 473/236 |
| 6,406,380 | B1 | | 6/2002 | Jackson | |
| 6,520,865 | B1 | | 2/2003 | Fioretti | |
| 7,264,557 | B1 | * | 9/2007 | Grossbard | 473/325 |
| 2006/0094532 | A1 | * | 5/2006 | Seeley | 473/330 |
| 2006/0166754 | A1 | * | 7/2006 | Kang | 473/242 |

* cited by examiner

*Primary Examiner*—Sebastiano Passaniti
(74) *Attorney, Agent, or Firm*—James L. Jackson

(57) ABSTRACT

A golf club, particularly a "putter" or "chipper", is provided with a concave ball striking face that establishes line contact with a golf ball rather than the usual point contact and enhances the capability of a user to control the direction of ball movement resulting from a golf stroke. The concave ball striking surface may be curved and may have the same or greater curvature than the curvature of a golf ball and may have smoothly and gently merging surface regions of compound curvature. The concave ball striking face surface may have compound regions including a curved region and a planar region being smoothly and gently merged. The concave ball striking surface may be defined on an integral metal club head structure or may be defined by a polymer insert that is recessed into an insert receiving receptacle of the club head. Additionally, the face portion of a golf club head may have a recessed face to further aid in training and to enhance the efficiency and accuracy of ball movement resulting from a golf stroke.

17 Claims, 3 Drawing Sheets

GOLF CLUB HEAD HAVING CONCAVELY CURVED FACE

Applicant hereby claims the benefit of U.S. Provisional Application Ser. No. 60/872,141 filed on Dec. 1, 2006 by Albert L. Hinojosa and entitled "Golf Putter Having Acetal Face insert With Concave Knurled Ball Striking Face", which Provisional Application is incorporated herein by reference for all purposes.

BACKGROUND OF THE INVENTION

1. Field of the Invention

This invention relates generally to the game of golf and more particularly concerns golf clubs known as "putters" which are used on golf greens to strike and move or putt a golf ball along the surface of a golf green to a hole or cup that is located in the green or "chippers", which are used to move or chip a golf ball located off the green to a position on the green and adjacent the cup. More particularly the present invention concerns the material from which the ball striking head portion of a golf putter or chipper is made and the configuration of the ball striking surface of the head portion of a putter or chipper.

2. Description of the Prior Art

Golf putters having putter heads have been manufactured having a wide variety of striking face configurations including flat striking surfaces and striking surfaces of convex and concave configuration. Golf putter heads have also been developed and manufactured having various types of ball striking face inserts, including inserts composed of polymer material.

The majority of the golf putters on the market at the present time have a flat metal or plastic ball striking face. With this flat faced design concept the striking face of a putter will make point contact with the generally spherical dimpled surface of a golf ball. It is important to maintain a straight alignment between the golf ball and the cup of a green or a path (a point) that allows for a right or left hand break of the path of the ball into the cup. Point contact of this nature requires a high degree of accuracy requiring that the flat face of the putter be oriented precisely at a right angle with the intended initial path of the ball. Any angular deviation of the striking face of the putter head will cause the ball to start its movement along an undesired or deviated path so that its propensity to roll left or right of the cup is typically the result. Golfers spend many hours practicing diligently to train their muscle memory in a manner so that the putter face is virtually always oriented at a right angle to the intended initial path of the ball at the time the ball is struck. After the ball is properly struck in a putting stroke, the slope or inclination of the surface of the green, the orientation of the blades of grass of the green and the wind velocity and direction are some of the many factors that must be taken into consideration in order to putt the ball along a proper path and into the cup.

Golf putters having a convexly or concavely curved ball striking face configuration nevertheless achieve point contact with the spherical surface of a golf ball and therefore have the same sort of problems or shortcomings as golf putters having flat faced ball striking configuration.

Accordingly, it is desirable therefore to provide a golf putter having a ball striking face that achieves greater surface contact between the face of a putter and the golf ball being struck thereby during a putting stroke. It is also desirable to provide a golf putter having a ball striking face having a spherical radius profile that incorporates and closely approximates or matches the spherical configuration of a golf ball so that essentially matching surface to surface ball contact results during a putting stroke.

SUMMARY OF THE INVENTION

It is a principal feature of the present invention to provide a golf putter club having a ball striking face configuration that more closely approximates the spherical configuration of a golf ball and thereby achieve line contact with a golf ball as compared with the usual point contact and provide for a more directionally controllable and efficient putting stroke.

It is another feature of the present invention to provide a golf putter or chipper club having a concave ball striking face with compound curvature.

It is also a feature of the present invention to provide a golf putter or chipper club having a concave ball striking face wherein the curvature closely approximates the curvature of the spherical surface of a golf ball.

It is an even further feature of the present invention to provide a golf putter or chipper club having a concave ball striking face wherein the curvature is greater than the curvature of the spherical surface of a golf ball.

Briefly, a golf club constructed according to the present invention has a head portion that is fixed to a golf club shaft in conventional manner. The head portion, which is particularly designed for use as a putter or chipper club is provided with a ball striking face of concave configuration which is designed to establish essentially line contact with the spherical dimpled surface of a golf ball rather than point contact as is the case with conventional golf clubs. A putter or chipper golf club head incorporating the present invention may be in the form of an integral head structure, typically composed of metal, or it may be in the form of a metal head having fixed thereto a striking face member, which may be composed of a similar or different metal or may be composed of a polymer material such as acetal or by any other suitable polymer material. The striking face member may be bonded to the metal head structure or may be secured thereto by any suitable mechanically interlocking system. The striking face member may be releasably secured to the metal head structure by means of suitable fasteners such as bolts or screws.

The striking face or striking face member defines a concave configuration having a curvature that is suitable to establish essentially line contact with the spherical dimpled surface of a golf ball. The curvature may closely approximate the curvature of a golf ball or may be of greater curvature as compared with the curvature of a golf ball. The curvature of the striking face may be of compound nature with sections of different curvature being merged by a gentle striking surface transition.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a partial sectional view of the lower, head portion of a golf putter club, showing a convexly curved ball striking face having a differing curvature in comparison with the spherical configuration of a golf ball;

FIG. 2 is a partial sectional view similar to that of FIG. 1 and showing a ball striking face of a golf putter club having a curvature closely approximating the spherical configuration of a golf ball;

FIG. 3 is a plan view of the head portion of a golf putter, showing a recessed ball striking face having similar curvature as compared with the ball striking faces of the golf putter clubs of FIGS. 1 and 2;

Figure 4:
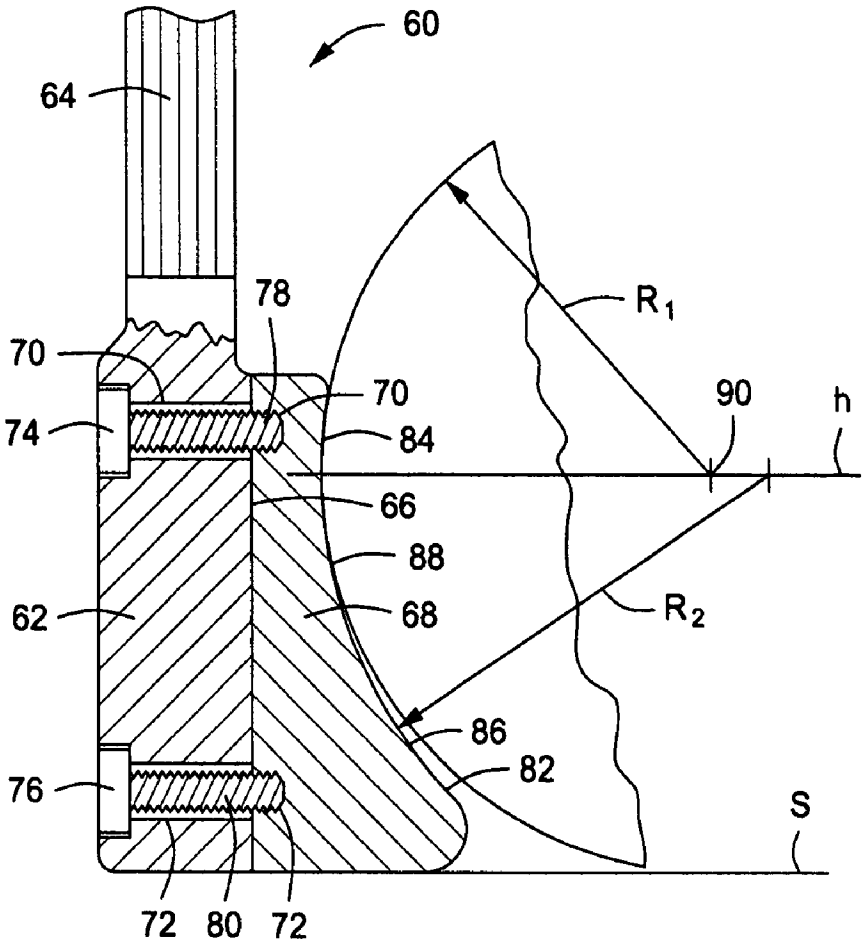
Figure 6:
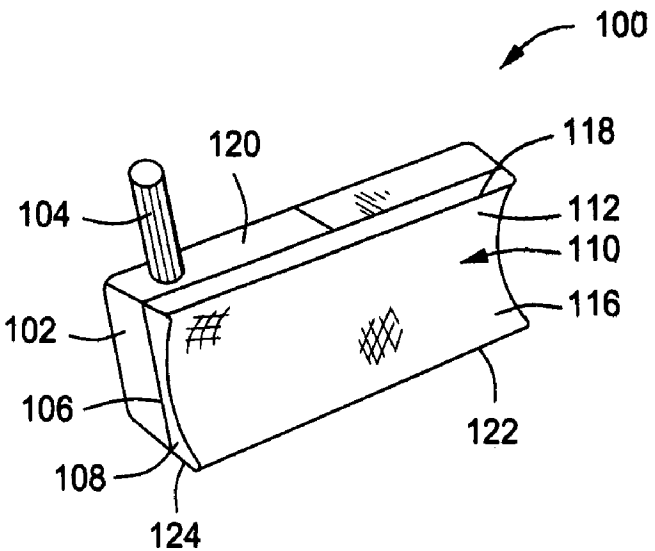
Figure 5:
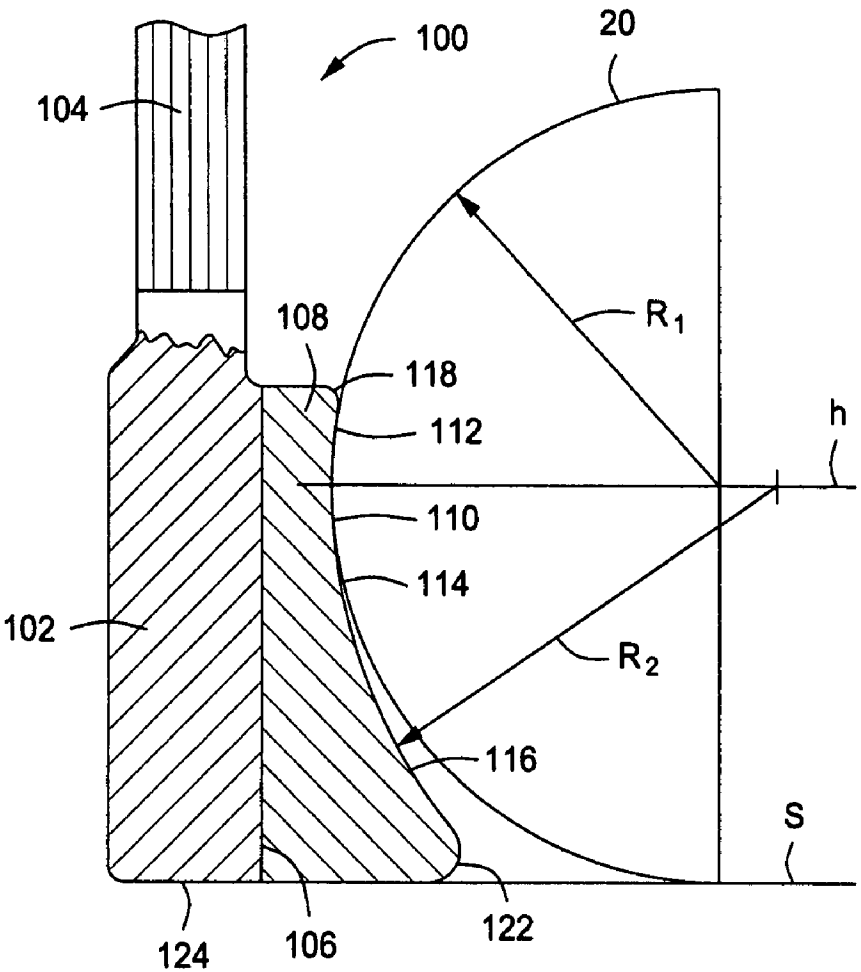

FIG. 4 is a partial sectional view of the head and shaft portions of a golf putter or chipper type golf club and further showing a striking face attachment being secured thereto by bolts or screws and also showing a concave ball striking face having compound curvature with an upper portion thereof approximating the spherical configuration of a golf ball and a lower portion thereof having a greater radius of curvature;

FIG. 5 is a partial sectional view similar to that of FIG. 4 and further showing the head and shaft portions of a golf putter or chipper type golf club having compound curvature; and FIG. 6 is a pictorial illustration of the club head portion of a golf club embodying the present invention and showing a ball striking face having an upper region of curved cross-sectional configuration smoothly merged with a lower region of substantially planar configuration.

DETAILED DESCRIPTION OF PREFERRED EMBODIMENT

Figure 1:
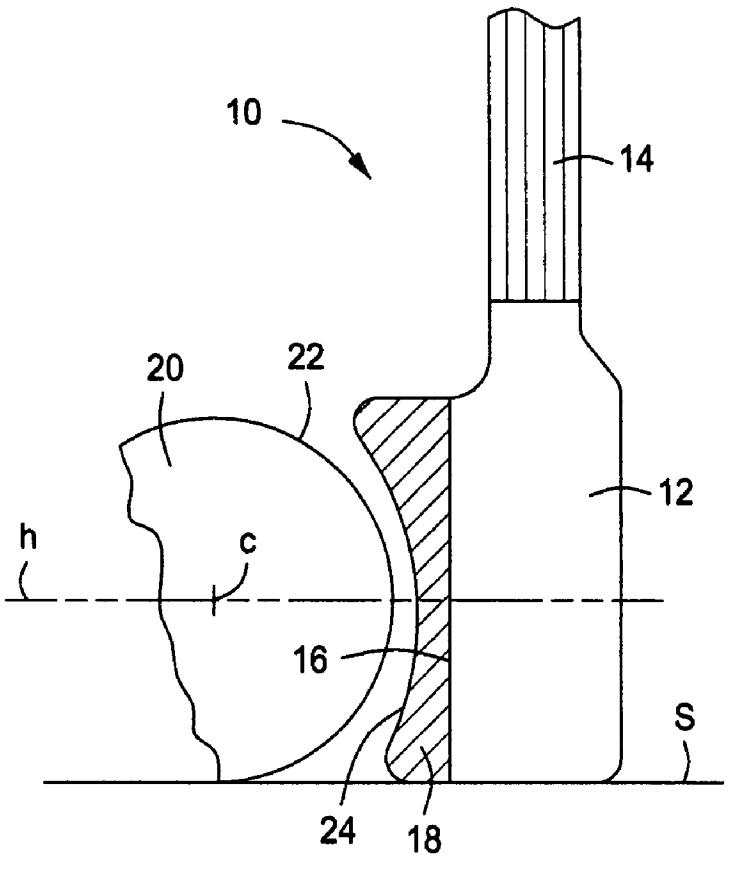

Referring now to the drawings and first to FIG. 1 a golf club embodying the principles of the present invention is shown generally at 10 and comprises a golf club head structure 12 which is typically composed of a metal such as plated steel, stainless steel or a composite metal composition. The golf club head structure 12 is fixed to a golf club shaft 14 which is composed of a wide range of shaft materials including plated tubular steel, graphite, fiberglass or a composite of these materials. The golf club head structure 12 defines a mounting face 16 to which is permanently or replaceably mounted a face attachment 18 that may be composed of a metal material such as steel, bronze, aluminum, etc. or any of a number of polymer materials, such as acetal. A wide range of other polymer materials may be employed for use as a face attachment without departing from the spirit and scope of the present invention. The face attachment may be secured to the golf club head in permanent fashion by cementing or bonding it in place if it is composed of a polymer material, brazing or welding it in place if it is composed of a metal material. The face attachment, whether composed of a polymer material or a metal material, may also be secured to the golf club head either permanently or removably by employing suitable means for mechanical retention. For example, screws or bolts may be employed to secure the face attachment to the golf club head. Also, the golf club head and the face attachment may be provided with mechanically interlocking structure such as interfitting dove tail mounts, especially when the face attachment is intended to be removed and replaced by another face attachment of different geometry and character. For permanent mounting of the face attachment to the attachment surface of the golf club head a cement or bonding agent may be employed for face attachment retention and retainer screws or bolts may extend through the golf club head structure and be received by threaded holes defined by the attachment face member. Since the golf club assembly will be subjected to considerable shock forces during normal use the screws or bolts will enhance the retention capability of the face attachment member to the golf club head. Additionally these retainer devices may be self locking or may be additionally secured against movement by being self-locking or being secured against dislodgement by a suitable polymer thread locking material.

If desired the golf club head structure may be an integral member, being composed of any of a number of metal compositions and may be machined, forged or molded to define an elongate concave ball striking surface thereon. Accordingly, it is not intended to limit the spirit and scope of the present invention to the use of metal and polymer components that are retained in fixed assembly.

A conventional golf ball 20 having the usual dimpled exterior spherical surface 22 is shown in each of the Figures of the drawings. The golf ball forms no part of the present invention, however the ball is shown to provide a comparison of its configuration with the configuration of a ball striking face of the face attachment 18. To facilitate understanding of the size and configuration of the golf club head structure and its attachment member a horizontal line or plane is shown which extends through the center of the golf ball and is oriented substantially horizontally or parallel with the surface of a golf green.

The face attachment 18 of the embodiment of FIG. 1 defines a ball striking surface 24 having a curvature that is defined from a radius that is greater than the radius of curvature of the golf ball 20. Additionally, the curved ball striking surface 24 is oriented so that with the shaft 14 of the golf club positioned vertically, as is the case when the ball striking surface 24 contacts the spherical surface of the golf ball 20, contact will be made with the ball at a location that is slightly above an imaginary horizontal line or plane "h" that passes through the center "c" of the golf ball. Due to the geometry of the curved ball striking surface 24 and its orientation with respect to the head structure of the golf club, line contact, rather than point contact, occurs between the curved ball striking surface and the spherical surface of the ball.

In the event the golf putter club should be slightly raised from the position shown in FIG. 1 at the time the golf ball is struck, thus being positioned slightly above the surface "s" of a golf green, as is often the case during the putting stroke, again line contact will occur though it will occur at a slightly lower part of the ball surface, but still above the horizontal line "h". If the golf putter club is both slightly raised above the surface "s" of the green and the shaft 14 of the club is oriented other than vertical, as is the case when the golf putter club is moving through the position of the ball during a long putting stroke where the ball remains in engagement with the striking face of the putter this line contact and the curvature of the lower portion of the striking face 24 will provide a slight lifting action to the ball so that the ball is efficiently started along the initial portion of the intended path to the cup of the green.

Figure 2:
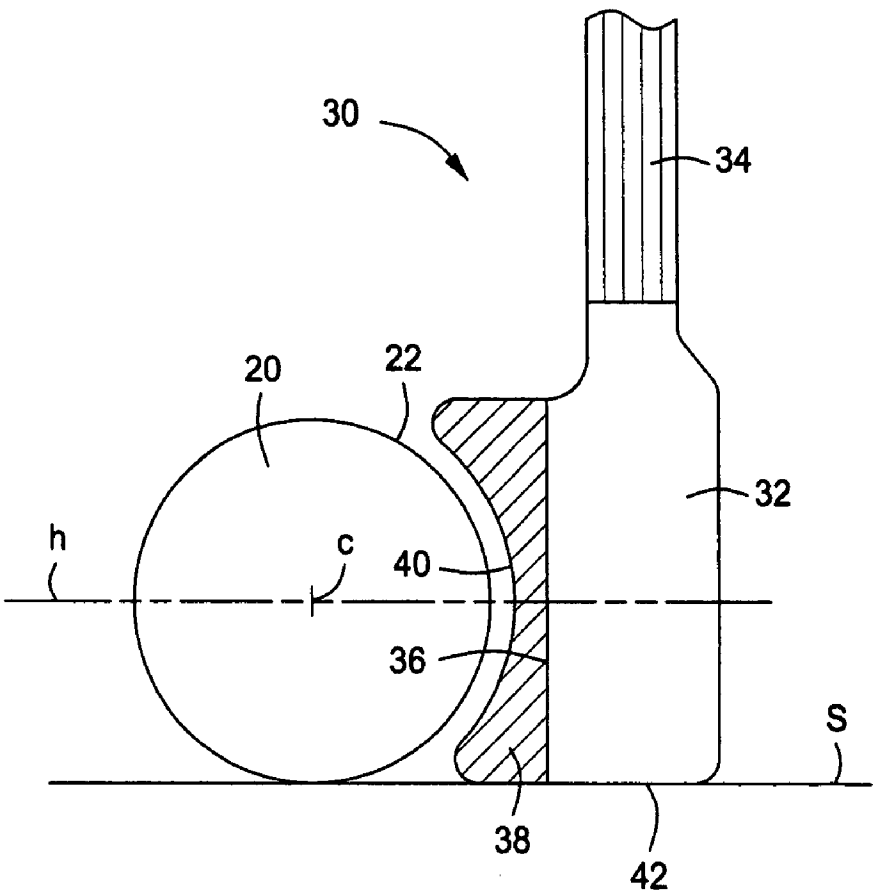

Referring now to FIG. 2, another embodiment of the present invention is illustrated wherein a golf putter club shown generally at 30 has a club head structure 32 that may be substantially identical as compared to the club head structure 12 of FIG. 1, and is connected with a golf club shaft 34 such as the shaft shown at 14 in FIG. 1. The golf club head structure 32 defines a mounting face 36 which is of generally planar configuration and may be prepared for attachment of a face attachment 38. The face attachment may be secured to the golf club head in permanent fashion by cementing or bonding it in place if it is composed of a polymer material, brazing or welding it in place if it is composed of a metal material. The face attachment may also be secured to the golf club head either permanently or removably by employing suitable means for mechanical retention. For example, screws or bolts may be employed to secure the face attachment to the golf club head. Also, the golf club head and the face attachment may be provided with mechanically interlocking structure such as interfitting dove tail mounts, especially when the face attachment is intended to be removed and replaced by another face attachment of different geometry and character.

The face attachment 38 defines a curved ball striking face 40 having essentially the same curvature as the curvature of the dimpled outer surface 22 of the golf ball 20. When the base surface 42 is positioned in contact or registry with the surface "s" of a golf course green essentially line contact will be established when the golf ball 20 is contacted by the striking face 40. This line contact will be directed laterally and generally parallel to the surface of the green as is depicted by the horizontal line "h". In the event the golf club should be slightly raised from the surface "s" of the golf green the ball striking face 40 will establish line contact with the spherical surface of the golf ball but will apply a striking force to the ball with a slightly upwardly directed force vector, thus slight lifting the ball during a putting or chipping stroke.

Figure 3:
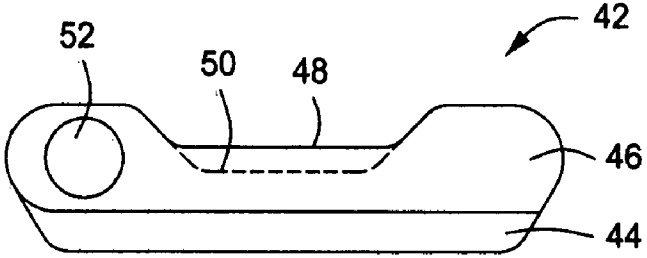

Referring to the plan view of FIG. 3 a putting or chipping golf club is shown generally at 42 having a golf club head structure 44 with a face attachment 46 defining a face recess 48. The face recess is partially defined by a curved ball striking surface 50 of the face attachment. A golf club shaft 52 is mounted to the club head structure 44 or to the face attachment 46 as shown.

An alternative embodiment of the present invention in the form of a golf putter or chipper club is shown generally at 60 in FIG. 4. The golf club 60 has a head structure 62 having a golf club shaft 64 mounted thereto in usual fashion. The golf club 60 has a head structure 62 defines an attachment mounting face 66 which is preferably of generally planar configuration though it may have other geometric form without departing from the spirit and scope of the present invention. A face attachment 68 may be mounted to the mounting face 66 in the manner described above or it may be removably mounted to the mounting face 66 in a manner permitting it to be removed and replaced with a face attachment of different configuration and/or material. As shown in FIG. 4, the face attachment 68 is shown to define screw or bolt holes 70 and 72 through which mounting screws or bolts 74 and 76 extend. Threaded extremities of the mounting screws or bolts 74 and 76 are received by internally threaded holes 78 and 80, thus permitting the face attachment 68 to be secured to the mounting face of the golf club head 62 by the retainer screws or bolts. Though only two face attachment retainer screws or bolts are shown it should be borne in mind that any suitable number of retainer members may be employed.

The face attachment 68 may be composed of a wide range of materials including metal, polymer materials, hard rubber, glass or a composite of any of these materials. The face attachment defines a ball striking surface shown generally at 82 having an upper curved face surface portion 84 and lower curved face surface portion 86 that are smoothly and gently merged at a region 88 intermediate the ball striking surface. The upper curved face surface portion 84 is shown to be generated by a radius "$R_1$" projected from a radius point 90, being the center-point of a golf ball resting on the surface "s" of a golf green. The lower curved face surface portion 86 has a greater curvature as compared with the curvature of the upper curved face surface portion 84 and is shown to be generated by a radius "$R_2$" projected from a radius point 92 that is also represented by an imaginary horizontal line "h" extending through the center-point of a golf ball.

Referring now to FIGS. 5 and 6, there is shown a golf club generally at 100, particularly a putter or chipper club having a club head structure 102 that is fixed in conventional fashion to a golf club shaft 104. The club head structure defines an attachment face 106 to which is secured a ball striking face attachment member 108. It is necessary that the attachment member 108 be fixed or locked in immovable relation with the club head structure 102. The ball striking face attachment member may be cemented or bonded to the attachment face 106 or it may be removably or permanently secured to the attachment face by means of suitable retainer or fastening members such as self-locking screws or bolts as shown in FIG. 4. Also, a combination attachment face retainer system, such as self-locking screws or bolts and a cement or bonding agent may be employed, since the golf club will be subject to significant shock forces during extended use. If desired, the attachment face of the club head 102 and the striking face attachment member 108 may each be provided with mechanically interlocking structures, such as dove-tail mounts, tongue and groove mounts and the like without departing from the spirit and scope of the present invention.

The ball striking face attachment member 108 defines a compound ball striking surface shown generally at 110 which may be grooved or knurled if desired to provide the surface with the capability of gripping the surface of a golf ball. The upper portion or region 112 of the compound ball striking surface is of curved cross-sectional configuration having a concave curvature that is substantially the same as the curvature of the outer dimpled surface of a golf ball. At an intermediate region 114 the concave curved surface region 112 is smoothly and gently merged with a substantially planar inclined surface region 116 that extends downwardly and forwardly and provides for imparting under-spin rotational movement to a golf ball and provides a golf ball with lift to provide a low trajectory of ball flight, such as when a golf ball is chipped from a short distance off a golf green onto the green and is caused to roll along the green to a position close to the cup. The upper portion or region 112 of the compound ball striking surface is rounded or radiused along an edge 118, with the radiused edge merging smoothly with a substantially planar upper surface 120 that is defined by the upper surface of the club head structure 102 and the upper surface of the ball striking face attachment member 108. The lower edge 122 of the ball striking face attachment member 108 is also rounded or radiused and merges smoothly with a bottom or heel surface 124 that is defined by the bottom of the club head structure and the bottom of the ball striking face attachment member 108

During a putting stroke only the curved upper surface region 112 of the ball striking face will contact a golf ball and will impart a force to the golf ball that is substantially parallel with the surface of a golf green. This will cause the ball to be simply rolled along the surface of the green to the cup. During a chipping stroke the lower angularly inclined substantially planar ball striking face region 116 will come into contact with the surface of a golf ball only when the club head and striking face attachment member have been moved forwardly from the position of FIG. 5 through an arc, with the bottom surface or heel 124 of the golf club head being lifted from and transitioned above the surface "s" of the golf green.

When the golf club of FIG. 5 is to be used for a chipping stroke the user will likely incline the golf club shaft forwardly, such as by placing the ball back in the golfer's stance, thus establishing more upright positioning of the lower angularly inclined substantially planar ball striking face region 116 when contact is made with the golf ball. Such positioning of the club head makes it easier for a golfer to move the club head through the longer grass making up the fringe of the green, lift the ball from the grass into the air and propel the ball with low flight movement to clear the fringe and cause the ball to land on the green with minimal backspin and with sufficient momentum and direction to roll to a position near the cup. During the follow-through phase of a golf chipping stroke the lower angularly positioned surface of the ball striking face will come more into play and will impart both backspin and loft to the golf ball as is appropriate for a chipping stroke.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A golf club for putting golf balls, comprising:

An elongate putter head structure mounted to a golf club shaft and having an elongate substantially flat bottom surface and having a defined putter head length and defining an attachment face; and an elongate concave ball striking surface being defined by said elongate putter head structure and extending along substantially the entirety of said defined length and being disposed in substantially parallel relation with said substantially flat bottom surface, said elongate concave ball striking surface having a curved portion having a curvature at least as great and not substantially greater as compared with the circular curvature of a golf ball;

a ball striking face attachment member being positioned in face to face relation with said attachment face and defining said elongate concave curved ball striking surface;

an attachment device permanently securing said ball striking face attachment member to said attachment face; and with said putter head structure oriented with said elongate substantially flat bottom surface substantially co-planar with a planar surface on which a golf ball also rests, an upper portion of said elongate concave curved ball striking surface of said putter head being located by said elongate putter head structure to establish substantially circular line contact with the spherical outer surface of a golf ball.

2. The golf club of claim 1, comprising:

said elongate concave ball striking surface being an elongate compound concave surface of said putter head being oriented in substantially parallel relation with said elongate substantially flat bottom surface and having an upper curved surface portion substantially matching the circular curvature of a golf ball and having a lower curved surface portion of greater curvature as compared with said upper curved surface portion and being smoothly and gently merged along said defined length with said upper curved surface portion.

3. The golf club of claim 1, comprising:

said attachment device being a quantity of cementing or bonding agent securing said face attachment member in fixed and permanently retained assembly with said attachment face.

4. The golf club of claim 1, comprising:

said attachment face being of substantially planar configuration;

said face attachment member having a corresponding substantially planar surface being positioned in intimate surface to surface relation with said substantially planar attachment face and defining said elongate concave ball striking surface;

attachment holes being defined by said elongate putter head structure and intersecting said substantially planar attachment face;

said face attachment member defining threaded holes in registry with said attachment holes; and threaded retainer members extending through said attachment holes and being threadedly received by said threaded holes and being tightened to secure said face attachment member in fixed assembly with said elongate putter head structure.

5. The golf club of claim 4, comprising:

said threaded retainer members being self-locking and upon being rotated to tightened locking position resisting counter-rotation and loosening by shock forces during use of the golf club.

6. The golf club of claim 1, comprising:

said elongate concave ball striking surface being defined by said elongate putter head structure and being a compound concave surface having an upper substantially cylindrical curved surface portion substantially matching the circular curvature of a golf ball and having a lower generally planar ball striking surface portion extending downwardly and angularly from said upper substantially cylindrical curved surface portion and being smoothly and gently merged with said upper substantially cylindrical curved surface portion; and said substantially cylindrical curved surface portion and said lower generally planar ball striking surface portion being grooved or knurled to minimize slipping during ball striking activity.

7. A golf club for golf ball putting activity, comprising:

an elongate putter head structure mounted to a golf club shaft and having an elongate bottom surface;

an elongate concave ball striking surface being defined by said elongate putter head structure and extending substantially the entire length of said elongate putter head structure and being disposed in substantially parallel relation with said elongate bottom surface, said elongate concave ball striking surface having an upper surface portion of substantially cylindrical configuration and having a curvature at least as great as the circular curvature of a golf ball, with said head structure oriented with said bottom surface substantially co-planar with a surface on which a golf ball also rests said upper portion of said elongate concave ball striking face being located to establish substantially circular line contact with the circular curvature of the golf ball, said elongate concave ball striking surface being a compound concave surface having a lower concave surface portion of greater configuration as compared with said upper substantially cylindrical curved surface portion and being smoothly and gently merged with said upper substantially cylindrical curved surface portion;

said elongate putter head structure defining an attachment face; and a ball striking face attachment member being mounted to said attachment face and defining said elongate concave ball striking surface.

8. The golf club of claim 7, comprising:

said elongate concave ball striking surface having a lower generally planar ball striking surface portion extending downwardly and angularly from said upper substantially cylindrical curved surface portion and being smoothly and gently merged with said upper substantially cylindrical curved surface portion.

9. The golf club of claim 7, comprising:

said elongate putter head structure defining an attachment face;

a face attachment member being positioned in intimate surface to surface relation with said attachment face;

attachment holes being defined by said elongate putter head structure and intersecting said attachment face;

said face attachment member defining threaded holes in registry with said attachment holes; and threaded retainer members extending through said attachment holes and being threadedly received by said threaded holes and being tightened to secure said face attachment member in fixed assembly with said attachment face.

10. The golf club of claim 9, comprising:

said threaded retainer members being self-locking and upon being rotated to tightened locking position resisting counter-rotation and loosening by shock forces during use of the golf club.

11. The golf club of claim 7, comprising:

said elongate putter head structure defining a substantially planar attachment face extending substantially along the entirety of said elongate putter head structure;

an elongate face attachment member having an elongate mounting surface being positioned in intimate surface to surface relation with said substantially planar attachment face; and a quantity of cementing or bonding agent in retaining relation with said substantially planar attachment face and said elongate mounting surface and securing said face attachment member to said substantially planar attachment face.

12. A golf club for golf ball putting activity, comprising:

an elongate putter head structure mounted to a golf club shaft and having an elongate bottom surface and defining an attachment face;

a face attachment member being secured in intimate surface to surface relation with said attachment face and defining an elongate substantially horizontally oriented concave ball striking face surface having a compound concave configuration defining an upper generally cylindrical curved surface portion having a cross-sectional curvature at least as great as the circular curvature of a golf ball, with said elongate puffer head structure oriented with said elongate bottom surface substantially parallel with a surface on which a golf ball also rests, an upper portion of said elongate concave ball striking face being located to establish line contact with the golf ball at a location above a substantially horizontal line extending through the center of the golf ball;

said elongate concave ball striking surface having a lower generally planar ball striking surface portion extending downwardly and angularly from said upper generally cylindrical curved surface portion and being smoothly and gently merged with said upper generally cylindrical curved surface portion.

13. The golf club of claim 12, comprising:

said face attachment member being composed of a polymer material.

14. The golf club of claim 12, comprising:

said face attachment member being composed of a metal material.

15. The golf club of claim 12, comprising:

attachment holes being defined by said golf club head and intersecting said attachment face;

said face attachment member defining threaded holes in registry with said attachment holes; and threaded retainer members extending through said attachment holes and being threadedly received by said threaded holes and being tightened to secure said attachment face in fixed assembly with said attachment face.

16. The golf club of claim 12, comprising:

said upper substantially cylindrical curved surface portion and said lower surface portion of greater curvature each being disposed in substantially parallel relation with said elongate bottom surface.

17. The golf club of claim 12, comprising:

said elongate concave ball striking surface being a compound concave surface having an upper substantially cylindrical curved surface portion substantially matching the circular curvature of a golf ball and having a lower generally planar ball striking surface portion extending downwardly and angularly forward from said upper curved surface portion to said elongate bottom surface and being smoothly and gently merged with said upper curved surface portion.

* * * * *